US005829597A

United States Patent [19]

Bielagus

[11] Patent Number: 5,829,597

[45] Date of Patent: Nov. 3, 1998

[54] AIR DENSITY SYSTEM WITH AIR RECIRCULATION AND GYRATING BAR FEEDER

[75] Inventor: Joseph B. Bielagus, Tualatin, Oreg.

[73] Assignee: Beloit Technologies, Inc., Wilmington, Del.

[21] Appl. No.: 733,811

[22] Filed: Oct. 18, 1996

Related U.S. Application Data

[63] Continuation-in-part of Ser. No. 313,979, Sep. 28, 1994, abandoned.

[51] Int. Cl.[6] ..... B07B 9/00

[52] U.S. Cl. ..... 209/29; 209/139.1; 209/365.1; 209/368

[58] Field of Search ..... 209/21, 22, 23, 209/28, 29, 133, 138, 139.1, 142, 393, 394, 366, 366.5, 367, 368, 365.1

[56] References Cited

U.S. PATENT DOCUMENTS

| | | | |
|---|---|---|---|
| 1,661,299 | 3/1928 | Peron | 209/29 |
| 2,679,316 | 5/1954 | Ruepp | 209/139.1 X |
| 2,828,011 | 3/1958 | Whitby . | |
| 2,852,137 | 9/1958 | Hagopian | 209/139.1 |
| 3,384,233 | 5/1968 | Bolles . | |
| 3,848,744 | 11/1974 | Flaherty | 209/393 |
| 4,166,027 | 8/1979 | Smith . | |
| 4,170,549 | 10/1979 | Johnson | 209/367 X |
| 4,465,194 | 8/1984 | Coleman . | |
| 4,486,300 | 12/1984 | Prieb . | |
| 4,915,824 | 4/1990 | Surtees | 209/139.1 |
| 5,110,453 | 5/1992 | Montgomery . | |

FOREIGN PATENT DOCUMENTS

| | | | |
|---|---|---|---|
| 400326 | 7/1909 | France . | |
| 545573 | 10/1922 | France . | |
| 828125 | 5/1938 | France . | |
| 1181399 | 6/1959 | France . | |
| 1599136 | 10/1990 | U.S.S.R. | 209/139.1 |
| 574908 | 1/1946 | United Kingdom . | |
| WO 87/06506 | 11/1987 | WIPO . | |

*Primary Examiner*—William E. Terrell
*Assistant Examiner*—Tuan N. Nguyen
*Attorney, Agent, or Firm*—Lathrop & Clark

[57] ABSTRACT

A air density separation has a vertical air separation chamber that opens downwardly to allow rejected material to fall out the chamber through the open bottom. The air density separator is configured to recirculate the air and entrained fines, and so minimizes emissions and costly air treatment processes. The air separation chamber is connected by a first duct to a cyclone. A fan is positioned adjacent the lower end of the air separation chamber, and draws air through a second duct out of the cyclone for reintroduction into the air chamber. The fan by way of the cyclone draws air through the first duct from the air separation chamber. The fan exhausts into the vertical air separation chamber below the material infeed through a plenum. An oscillating screen composed of bars extends into the separation chamber of the air density separator and is used to disperse material into the separation chamber. The bars are spaced apart to allow air to be drawn up through the bars to separate the light component in the feed material from heavier materials. A tray to which the bars are mounted are caused to oscillate by an eccentric weight which is mounted to the bars and driven to oscillate in a horizontal plane. The tray is suspended by four universal linkages to a support frame, the linkages allowing the tray and attached bars to oscillate.

28 Claims, 3 Drawing Sheets

AIR DENSITY SYSTEM WITH AIR RECIRCULATION AND GYRATING BAR FEEDER

RELATED APPLICATION

This application is a continuation-in-part of application Ser. No. 08/313,979 filed Sep. 28, 1994, now abandoned.

FIELD OF THE INVENTION

The present invention relates to apparatuses and methods for separating fractions of a particulate material in general. More particularly, the present invention relates to apparatuses and methods for utilizing air to separate components of a particulate material on the basis of differing attributes.

BACKGROUND OF THE INVENTION

The separation of a particulate material into various fractions on the basis of density is performed in many industrial processes. In the mining industry, heavy minerals are concentrated from ores for extraction. In agriculture, grain is separated from chaff and leaves are separated from stalks by a current of air that lifts the lighter chaff or leaves away from the grain or stalks. In the wood pulping industry, a device known as an air density separator has been employed to separate light wood chips from chips containing knots which are more dense.

An air density separator uses a vertical separation chamber through which a stream of air is drawn. Wood chips to be separated are metered by an auger into the separation chamber where the high velocity air stream disperses the chips evenly over the chamber. The more dense knots fall through the uprising current of air and are rejected. The lighter chips are drawn from the separation chamber by the flow of air and separated from the air by a cyclone.

In the production of paper from wood fibers, the wood fibers must be freed from the raw wood. One widely used method of accomplishing this is to process the wood fibers in a cooking liquor so that the material holding the fibers together, lignin, is dissolved. To achieve rapid and uniform digestion by the cooking liquor, the wood, after it has been debarked, is passed through a chipper that reduces the raw wood to chips.

As a natural consequence of the harvesting and processing of pulp logs, some sand, rocks, and tramp metal find their way into the raw wood chips. Further, a certain percentage of the raw wood is comprised of knots which are in general undesired in the papermaking process because they add dark fibers that increase the bleaching requirement and because they contain resinous material. The knots, which are typically of a higher density because the wood is dense and resinous, together with tramp metal and rocks, must be separated from the raw wood chips before further processing.

One highly successful method of accomplishing this separation is the air density separator. In one known successful system, chips are supplied by a metering screw conveyor infeed to a separation chamber through which a stream of air is drawn. The chips are entrained in the air stream while the higher density knots, stones and tramp metal move against the current of air under the force of gravity. The acceptable chips and air then pass into a cyclone where the chips are separated from the air, the air being drawn by a vacuum into a fan and exhausted.

While the air density separator is the most effective and discriminating system available, it has some less desirable features. First, it requires a baghouse to remove dust from the exhaust air. The baghouse is expensive and requires labor intensive maintenance. Further, use of a baghouse results in higher energy cost because of the air pressure necessary to move the air through the filters. Conventional air density separators use air velocities of 4,000 to 5,000 feet per minute which functions well at dispersing and separating larger wood chips from knots, rocks, and tramp metal. However if small chips require separation from sand and dust a lower velocity air flow is required. Here the conventional method of dispersing the material to be separated in the air stream is not effective.

What is needed is an air density separator that eliminates the requirement for a baghouse and can process lightweight materials in a low velocity air stream.

SUMMARY OF THE INVENTION

The air density separation apparatus of the present invention employs a vertical air separation chamber that opens downwardly to allow rejected material to fall out the chamber through the opening. The air density separator is configured to recirculate the air and entrained fines, and so minimizes emissions and costly air treatment processes. The air separation chamber is connected by a first duct to a cyclone. A fan is positioned adjacent the lower end of the air separation chamber, and draws air through a second duct out of the cyclone for reintroduction into the air chamber. The fan thus draws air through the first duct from the air separation chamber by way of the cyclone. The fan exhausts into the vertical air separation chamber below the material infeed through a plenum.

In separating low density materials such as shredded plastic bottles from paper, and small wood chips from sand, a means for distributing these materials into a low velocity air stream of about 1,500 feet per minute or less is required. Without proper distribution means, lightweight materials 56 in a low velocity air stream are not adequately distributed by the air stream alone, and thus clumps of material may fall through the bottom of the air chamber before the components are separated.

The means for distributing materials into an air density separator air stream is an oscillating screen composed of bars that extend into the separation chamber of the air density separator. The bars slope downwardly about seven degrees from the horizontal. The bars are spaced apart to allow air to be drawn up through the bars to separate the light component in the feed material from heavier materials. The bars connect to a pan which forms the bottom of an inlet hopper. The pan and bars are caused to oscillate by an eccentric weight which is mounted to the tray and driven to oscillate in a horizontal plane. The tray is suspended by four universal linkages to a support frame, the linkages allowing the tray and attached screen to oscillate.

It is a feature of the present invention to provide an air density separator that does not require a baghouse.

It is another feature of the present invention to provide an air density separator that can handle lightweight materials using a low velocity air stream.

It is a further feature of the present invention to provide an air density separator which provides clumping of fines so they can be more easily be removed from the air stream by a cyclone.

It is yet another feature of the present invention to provide an air density separator feed system which distributes lightweight materials into the air stream of the air chamber of an air density separator.

Further objects, features and advantages of the invention will be apparent from the following detailed description when taken in conjunction with the accompanying drawings.

DESCRIPTION OF THE PREFERRED EMBODIMENT

Figure 1:
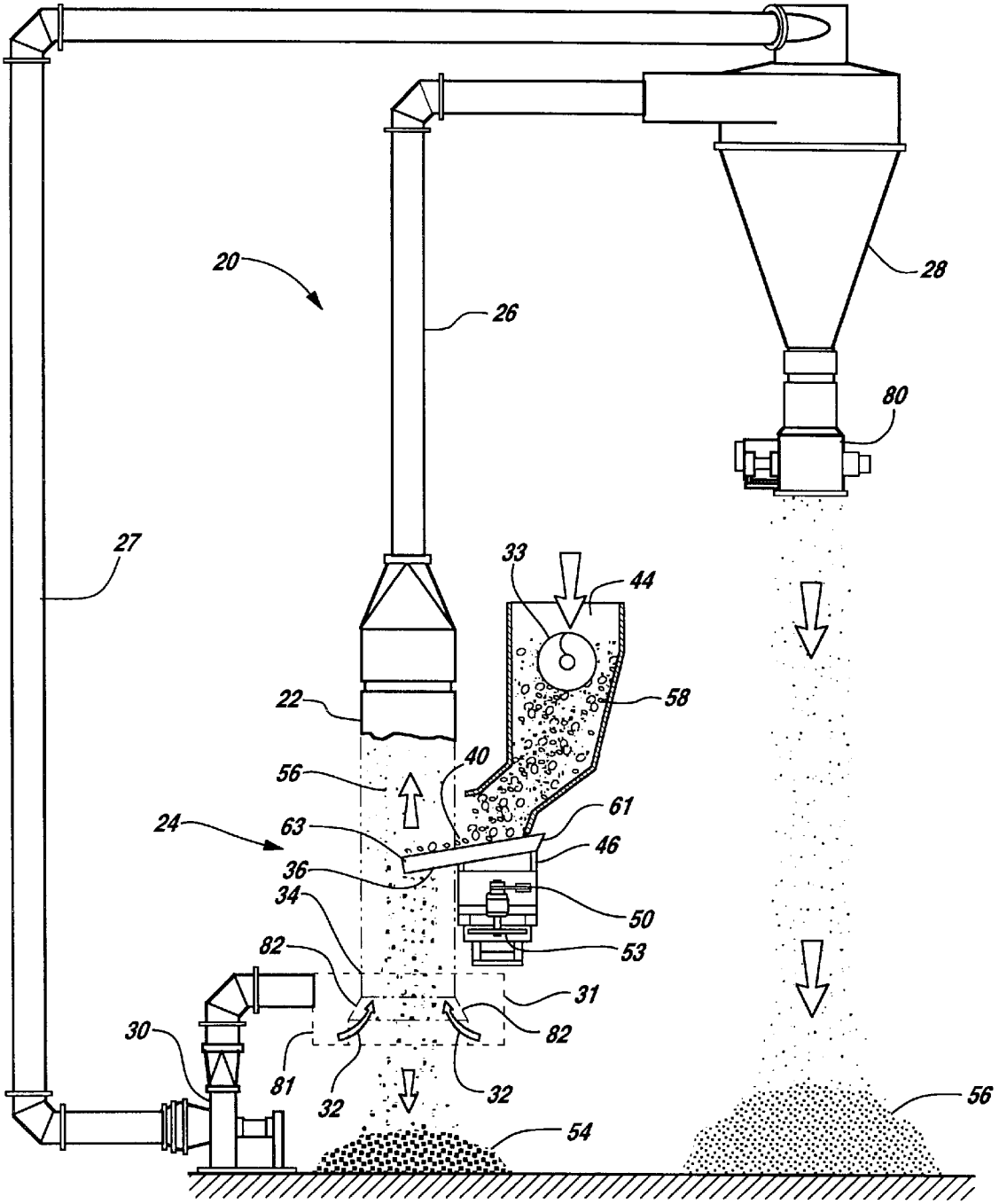
FIG. 1 is a side-elevational somewhat schematic view of the air density separator of this invention.
Figure 2:
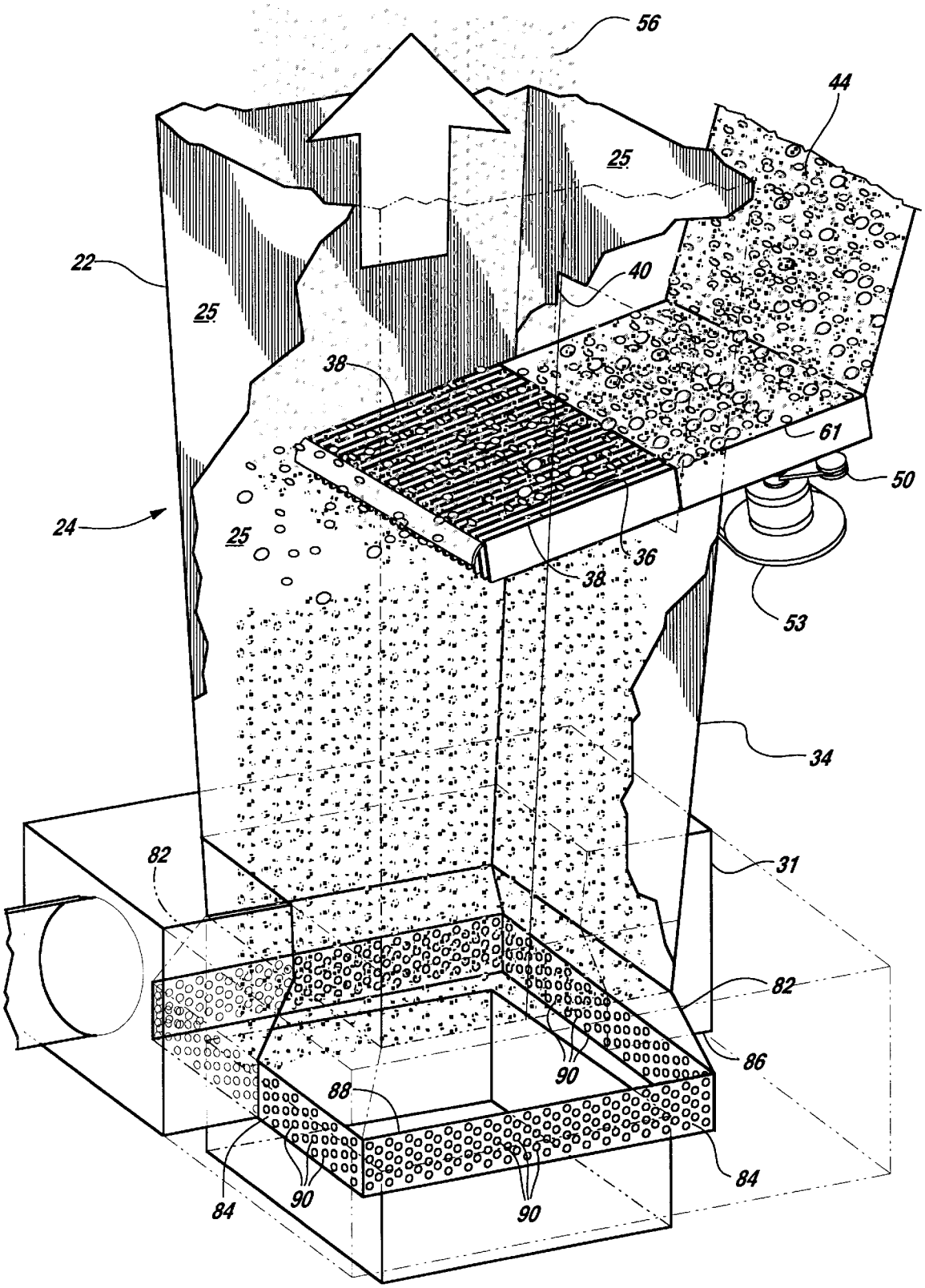
FIG. 2 is an isometric view, partly cut away, of the separation chamber and infeed mechanism of the air density separator of FIG. 1.
Figure 3:
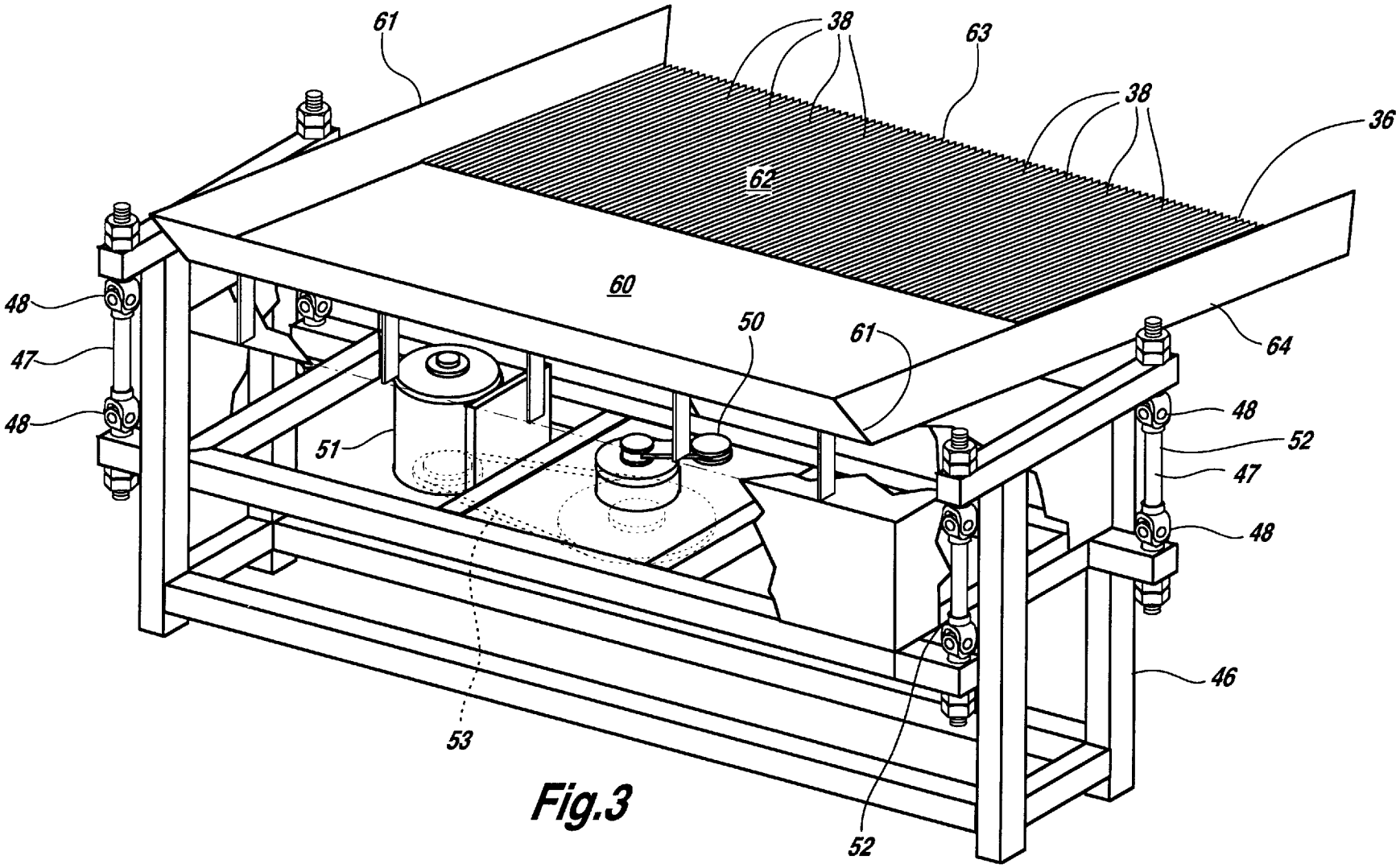
FIG. 3 is a front elevational isometric view of the infeed apparatus of FIG. 1.

Referring more particularly to FIGS. 1–3 wherein like numbers refer to similar parts, an air density separator 20 is shown in FIG. 1. The air density separator 20 has a vertically disposed chamber 22 with walls 25 which define a vertical air separation chamber 24. Mixed particulate matter 44 is introduced into the separation chamber 24 from a material hopper 58. An auger 33 is provided to distribute the particulate material 44 across the hopper 58. However, depending on the feed system and the natural angle of repose of the material 44, baffles alone may be substituted for the auger. The material 44 is introduced into the air separation chamber 24 at an oscillating infeed 61.

The air density separator 20 is configured to recirculate the air and entrained fines, and hence minimizes emissions and costly air treatment processes. The air separation chamber 24 is connected by a first duct 26 to a cyclone 28. A fan 30 is positioned adjacent the bottom or lower end 34 of the air separation chamber 24, and draws air through a second duct 27 out of the cyclone 28 for reintroduction into the air chamber 24. The fan 30 thus draws air through the first duct 26 from the air separation chamber 24. The fan 30 exhausts into the vertical air separation chamber 24 below the material infeed 61 through a plenum 31.

When the material 44 is introduced at the infeed 61 into the upward air stream within the air separation chamber 24, heavy particles fall down past the plenum 31 at the bottom 34 of the chamber 24. A stream of air, indicated by arrows 32, enters the chamber 24 from the plenum 31, and is drawn upward through the first duct 26 into the cyclone 28, where denser particles are thrown outwardly to the walls of the cyclone. Most of the air and the less dense particles such as fines is drawn out of the cyclone through the second duct 27 for reintroduction into the air separation chamber 24 at the plenum 31.

The oscillating infeed 61 receives material 44 discharged from the hopper 58 which travels along a pan 60 inclined about seven degrees from the horizontal, onto a foraminous screen formed by a grill 36 extending from the pan 60 into the air separation chamber 24. The grill 36 has a multiplicity of closely spaced narrow bars 38 which extend into the chamber 22 from a material inlet 40. The grill 36 is cantilevered from the pan 60 which is suspended from a mount 46 which supports the pan on four pairs 47 of linked universal joints 48.

An eccentric mass 50 is rotatably driven by a motor 51 through a drive system 53. The eccentric mass and its motor and drive system are mounted to the pan 60 and cause the pan 60 and the grill 36 to oscillate at five to fifteen Hz, but preferably at ten Hz.

An eccentric weight can be readily adjusted to vary the frequency and amplitude of the oscillation by adjusting the size of the mass, the moment arm of the mass and the speed of the rotating mass. Although a system of springs could be used to mount the pan 60 to the mount 46, springs are subject to fatigue. Therefore a suspension system constructed of the pairs 47 of universal joints 48 is employed. Two universal joints 48 are connected by a short shaft 52 to form a pair 47 of universal joints. Because the joined universal joints provide freedom of motion without the elastic strain present in a spring, they can be designed for an infinite fatigue life. The use of relatively low frequency oscillation also means that structural modes within the pan 60 and the grill 36 are less likely to be excited.

Certain materials will be entrained in the upwardly moving air and will leave the separation chamber through the first duct 26. The remaining particulate material which is not entrained will pass through or over the grill 36 and will exit the separation chamber 24 through the bottom 34 of the chamber 22. Material exiting the bottom of the grill 36 may be collected on a conveyor or the like. Very lightweight dust and particles are too light to be removed by the cyclone 28 and thus recirculate with the air. Over time the fine particles conglomerate into larger clumps which the cyclone can remove. The precise mechanism for agglomeration is not fully understood but may include the dust grains developing an electrical charge which causes them to attract each other.

In a conventional air density separator, air is drawn up through the separation chamber at four to five thousand feet per minute while the granular material to be separated such as wood chips is dispensed into the air chamber either by a chute with an air lock or by an auger which distributes the material across the separation chamber. In a conventional air density separator the high velocity air stream moving up through the separation chamber is usually effective to disperse the granular material being separated in the air stream. Materials which are sufficiently dense fall down through the separation chamber whereas lighter materials become entrained in the air and are drawn into a cyclone where they are separated. The recirculating air density separator 20 shown in FIG. 1 may be used with any suitable air velocity for a particular application. However the use of an oscillating infeed 61 is particularly advantageous where lightweight materials are being dispersed into a low velocity stream of air.

An air density separator separates a particulate matter depending on what is known in the aerodynamic field as ballistic coefficient. Ballistic coefficient is a function of the density of the object, the area of the object presented to the air stream, and a shape-dependent coefficient. Thus, the ballistic coefficient of an object increases with its density, decreases with increasing area and decreases with increasing bluntness of the object facing the air stream. Ballistic coefficient controls the maximum rate at which an object will fall through a still column of air. Because resistance to motion of an object through the air increases with velocity, an object which is accelerated by the earth's gravitational force eventually reaches an equilibrium velocity where the acceleration force of gravity is balanced by the drag force of the air through which the object is moving.

This principal is used to separate the granular material into two or more components based on the ballistic coefficient of the granules. By introducing the granules into an upwardly moving stream of air which has a velocity which is greater than the terminal velocity of some of the particles and less than the terminal velocity of other particles, the granular material will be separated into two fractions. Thus, for separating wood chips from wood knots, an air velocity in the range of four to five thousand feet per minute is chosen which exceeds the terminal velocity of the wood chips, thereby causing them to rise to the top of the air chamber and be transported through a duct to a cyclone. On the other hand, the knots, which have a terminal velocity greater than four to five thousand feet per minute, fall through the air to exit the bottom of the separation chamber.

An exemplary problem addressed by the low velocity air density separator 20 is separating small wood chips and sawdust from sand and dirt. The high cost of wood fiber combined with a desire to minimize waste has produced a demand for the capability to recover wood fiber from material which may have been discarded in the past. Because wood chips, sawdust fines and needles of wood are of lower density than the sand and dust with which they are mixed, they have a higher ballistic co-efficient and can be separated in theory in an air density separator. However, all small particles have relatively low ballistic coefficients because the area of the particle dominates as particles become smaller, so the velocity of the air in the air density separator must be lower, preferably in the range of five hundred to a thousand feet per minute. The problem with using these low velocities in an air density separator can be readily demonstrated by taking a handful of paper confetti such as the punchings from a paper punch and dropping them into the air. Some of the paper punchings will become dispersed and rapidly reach their terminal velocity and slowly settle to the floor. Others, however, will clump together and fall as a unit reaching the floor before the dispersed punchings. Thus, with lightweight materials, they must be adequately dispersed in the column of air moving up through the vertical air separation chamber 24 if it is desired to reliably separate them on the basis of their ballistic coefficients.

In the air density separator 20 proper dispersion is accomplished by the grill 36 formed of closely spaced narrow bars 38. In a chamber having dimensions of approximately nine feet by two feet, the bars 38 would have a depth of one-and-a-half inches with a thickness of one-and-a-half to three millimeters and a bar-to-bar gap of between one-eighth of an inch and one inch depending on the size of the material being separated.

The bars 38 are formed into the grill 36 within a frame 64. One or more transverse reinforcements (not shown) may be installed on the underside of the grill 36 formed by the bars 38.

As shown in FIG. 2, material 44 is fed onto the pan 60 onto the deck 62 of the grill 36. The pan 60 abuts the grill 36 which extends into the separation chamber 24. The oscillating grill 36 disperses the granular material across the deck. The air stream which passes up through the bars 38 of the deck lofts the lightweight particulate matter and entrains it in the flow of air. The heavier material 54 slides through the bars or drops off the end 63 of the deck 62 formed by the bars 38.

The cyclone 28 uses centrifugal forces to separate the majority of the particulate material from the air stream. The cyclone has an air lock 80 which allows the lighter fraction to be removed from the cyclone. The air that is withdrawn from the cyclone passes through the fan and is then reinjected into the bottom 34 of the of the air separator chamber 24 through a plenum 31. The plenum 31 is a rectangular box 81 which is fed tangentially with air from the fan 30. Portions 82 of the walls 25 of the air separation chamber 24 adjacent to the plenum 31 are angled into the plenum 31. The gap 84 between the angled portions 82 and the wall 86 of the plenum 31 is closed with a grid of metal 88 with ½ inch holes 90. The gap 84 forms a continuous opening about the circumference of the chamber 24. The grid 88 produces a pressure drop as air moves from the plenum 31 into the separation chamber 24. The pressure drop helps to equalize the air flow into the chamber 24

It should be understood that the low velocity air density separator 20 may employ a foraminous member of configuration other than a grill of narrow bars. For example, the foraminous member could be a vibrating screen, or a vibrating plate with holes punched therein. It should be understood that a means for oscillating the grill could include a solenoid which magnetically engages the grill causing it to vibrate.

It should also be understood that the low velocity air density separator may be used to separate shredded post-consumer plastic containers. The recycling of post-consumer plastic bottles results in a feed stock formed by the shredding of plastic milk bottles or plastic pop bottles. The feed stock contains both plastic from the bottles and paper from the labels associated with the bottles. Because the plastic shards are of a thicker gauge of material than the paper or light grade plastic labels, they can be separated in an air density separator. The velocity of the air in the air density separator will be preferably in the range of seven to eight hundred feet per minute.

It is understood that the invention is not limited to the particular construction and arrangement of parts herein illustrated and described, but embraces such modified forms thereof as come within the scope of the following claims.

I claim:

1. An air density separator comprising:

a substantially vertically extending chamber having walls with a top and a downwardly open bottom, the walls defining a passage for the upward flow of air, and an inlet admits mixed particulate material into the chamber at a position between the top and the bottom;

a duct connected to the top of the chamber and joined thereto so as to allow air to be drawn up through the chamber;

a cyclone connected to receive air from the duct;

a fan having an inlet and an outlet, the inlet connecting to the cyclone to draw air through the cyclone, the fan outlet connected to the chamber beneath the particulate material inlet to cause air to recirculate through the chamber and the cyclone, wherein the outlet of the fan is connected to a plenum adjacent to the open bottom, the plenum supplying air to the chamber through portions of the chamber walls forming openings to allow air from the plenum to enter the chamber.

2. The apparatus of claim 1 wherein the chamber walls are angled outwardly into the plenum above the openings.

3. The apparatus of claim 2 wherein the openings are closed with a grid of metal which allows the passage of air while producing a pressure drop which facilitates the even distribution of air from the plenum into the chamber.

4. The apparatus of claim 1 wherein the openings in the chamber walls form a continuous opening around a circumference of the chamber.

5. An apparatus for separating mixed particulate material comprising:

a substantially vertically extending chamber having walls with a top and a downwardly open bottom, the walls defining a passage for the upward flow of air, and an inlet admits mixed particulate material into the chamber at a position between the top and the bottom;

a duct connected to the top of the chamber and joined thereto so as to allow air to be drawn up through the chamber;

a cyclone connected to receive air from the duct;

a fan having an inlet and an outlet, the inlet connecting to the cyclone to draw air through the cyclone, the fan outlet connected to the chamber beneath the particulate material inlet to cause air to recirculate through the chamber and the cyclone;

a foraminous member extending into the chamber and into the air passage; and a means for oscillating the foraminous member, wherein mixed particulate material discharged onto the foraminous member at the inlet is thus dispersed into an upwardly moving air stream within the chamber, certain particles being entrained in the air and transported out of the chamber upwardly, and other particles passing through the foraminous member to exit the chamber bottom, wherein the outlet of the fan is connected to a plenum adjacent to the open bottom, the plenum supplying air to the chamber through portions of the chamber walls forming openings to allow air from the plenum to enter the chamber.

6. The apparatus of claim 5 wherein the foraminous member comprises a plurality of narrow bars arrayed in spaced parallel relation.

7. The apparatus of claim 6 wherein the bars are between one-and-a-half and three millimeters wide and are spaced apart between one-eighth of an inch and one inch.

8. The apparatus of claim 5 wherein the foraminous member is suspended without springs from a universal mount so the foraminous member can oscillate.

9. The apparatus of claim 5 further comprising a feed chute opening into the chamber and positioned above the foraminous member for delivering mixed particulate material to the foraminous member.

10. The apparatus of claim 5 wherein the chamber walls are angled outwardly into the plenum above the openings.

11. The apparatus of claim 10 wherein the openings are closed with a grid of metal which allows the passage of air while producing a pressure drop which facilitates the even distribution of air from the plenum into the chamber.

12. The apparatus of claim 5 wherein the openings in the chamber walls form a continuous opening around a circumference of the chamber.

13. The apparatus of claim 5 wherein the means for oscillating the foraminous member is an eccentric mass which is caused to rotate and is mounted to the foraminous member causing it to oscillate.

14. A method for separating a granular material comprising the steps of:

delivering a stream of granular material to an oscillating foraminous member enclosed in a chamber with an open bottom, wherein, the granular material has at least two components having differing terminal velocities; and drawing a current of air up through the chamber from the open bottom such that at least a portion of the air passes through the foraminous member, wherein the air passing through the foraminous member disperses the granular material so it is separated on the basis of the terminal velocity of the material in the current of air; and processing the current of air through a cyclone to separate one component of the granular material; and, returning the current of air to a plenum adjacent to the open bottom, and supplying, air from the plenum through portions of the chamber walls forming openings to allow air from the plenum to enter the chamber so the current of air repeatedly circulates through the chamber.

15. The method of claim 14 wherein the granular material being separated is comprised of wood chips and sand.

16. An apparatus for separating a mixed particulate material having at least two components of differing terminal velocities, the apparatus comprising:

a substantially vertically extending chamber having a bottom open to the atmosphere and a top which is connected to a duct, allowing a stream of air to be drawn from the bottom to the top of the chamber;

a grill of narrow bars arrayed in spaced parallel relation which extends into the chamber, wherein the grill is mounted for oscillatory motion such that the bars slope downwardly into the chamber, a means for causing the grill to oscillate in driving relation with the grill;

a pan extending into the chamber and connected to the grill which delivers mixed particulate material having at least two components of differing terminal velocities to the grill;

a cyclone in receiving relation with the duct at the top of the chamber, wherein the component of the mixed particulate material having a lower terminal velocity is entrained in the air received in the cyclone and is separated from the air therein; and a fan having an inlet connected to the cyclone for pulling the stream of air through the chamber and the cyclone, the fan having an outlet connected to the bottom of the chamber so that air drawn from the cyclone is recirculated through the chamber, wherein the outlet of the fan is connected to a plenum adjacent to the open bottom, the plenum supplying air to the chamber through portions of the chamber walls forming openings to allow air from the plenum to enter the chamber.

17. The apparatus of claim 16 wherein the bars forming the grill are between one and a half and three millimeters wide and are spaced apart between one-eighth and one-quarter of an inch.

18. The apparatus of claim 16 wherein the grill is resiliently mounted externally to the chamber and slopes downwardly into the chamber.

19. The apparatus of claim 16 wherein the chamber walls define a selected cross-sectional area, and wherein the fan has the capability of drawing between five hundred and one thousand cubic feet of air per minute per square foot of cross-sectional area of the chamber when running at its maximum capacity.

20. An apparatus for separating mixed particulate material comprising:

a substantially vertically extending chamber having walls with a top and a downwardly open bottom, the walls defining a passage for the upward flow of air, and an inlet admits mixed particulate material into the chamber at a position between the top and the bottom;

a duct connected to the top of the chamber and joined thereto so as to allow air to be drawn up through the chamber;

a cyclone connected to receive air from the duct;

a fan having an inlet and an outlet, the inlet connecting to the cyclone to draw air through the cyclone, the fan outlet connected to the chamber beneath the particulate material inlet to cause air to recirculate through the chamber and the cyclone;

a foraminous member extending into the chamber and into the air passage; and an oscillator mounted to the foraminous member, wherein mixed particulate material discharged onto the foraminous member at the inlet is thus dispersed into an upwardly moving air stream within the chamber, certain particles being entrained in the air and transported out of the chamber upwardly, and other particles passing through the foraminous member to exit the chamber bottom, wherein the outlet of the fan is connected to a plenum adjacent to the open bottom, the plenum supplying air to the chamber through openings in the plenum to allow air from the plenum to enter the chamber.

21. The apparatus of claim 20 wherein the foraminous member comprises a plurality of narrow bars arrayed in spaced parallel relation.

22. The apparatus of claim 21 wherein the bars are between one-and-a-half and three millimeters wide and are spaced apart between one-eighth of an inch and one inch.

23. The apparatus of claim 20 wherein the foraminous member is suspended without springs from a universal mount so the foraminous member can oscillate.

24. The apparatus of claim 20 further comprising a feed chute opening into the chamber and positioned above the foraminous member for delivering mixed particulate material to the foraminous member.

25. The apparatus of claim 20 wherein the means for oscillating the foraminous member is an eccentric mass which is caused to rotate and is mounted to the foraminous member causing it to oscillate.

26. The apparatus of claim 20 wherein the chamber walls are angled outwardly into the plenum above the openings.

27. The, apparatus of claim 20 wherein the openings are closed with a grid of metal which allows the passage of air while producing a pressure drop which facilitates the even distribution of air from the plenum into the chamber.

28. The apparatus of claim 20 wherein the openings in the chamber walls form a continuous opening around a circumference of the chamber.

* * * * *